US009038614B2

(12) United States Patent
Valencia

(10) Patent No.: US 9,038,614 B2
(45) Date of Patent: May 26, 2015

(54) CAM COVER COIL ON PLUG RETENTION VIA OIL SEPARATOR

(75) Inventor: Frank Acierno Valencia, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 735 days.

(21) Appl. No.: 13/300,107

(22) Filed: Nov. 18, 2011

(65) Prior Publication Data

US 2012/0204847 A1 Aug. 16, 2012

Related U.S. Application Data

(60) Provisional application No. 61/443,609, filed on Feb. 16, 2011, provisional application No. 61/444,392, filed on Feb. 18, 2011.

(51) Int. Cl.

| | |
|---|---|
| ***F02P 3/02*** | (2006.01) |
| ***F02P 13/00*** | (2006.01) |
| ***F01M 13/04*** | (2006.01) |
| *H01F 38/12* | (2006.01) |

(52) U.S. Cl.

CPC . *F02P 3/02* (2013.01); *H01F 38/12* (2013.01); *F01M 13/0416* (2013.01); *F02P 13/00* (2013.01)

(58) Field of Classification Search

CPC ..... H01F 38/12; F02P 13/00

USPC ..... 123/143, 145.5 C, 169 PA, 169 PH, 634, 123/635; 439/127, 128, 817, 818, 847

See application file for complete search history.

(56) References Cited

U.S. PATENT DOCUMENTS

| | | | | |
|---|---|---|---|---|
| 6,087,918 | A * | 7/2000 | Henry et al. | 336/96 |
| 6,427,674 | B1 * | 8/2002 | Wylin | 123/634 |
| 6,513,506 | B1 * | 2/2003 | Ito et al. | 123/568.13 |
| 6,672,296 | B2 * | 1/2004 | Ito et al. | 123/672 |
| 7,234,454 | B2 * | 6/2007 | Tauchi et al. | 123/634 |
| 7,509,951 | B1 * | 3/2009 | Smith | 123/573 |
| 7,629,869 | B2 * | 12/2009 | Fujiyama | 336/90 |
| 8,061,338 | B1 | 11/2011 | Gibboney et al. | |
| 8,065,983 | B2 * | 11/2011 | Smith et al. | 123/90.38 |
| 8,651,078 | B2 * | 2/2014 | Fasold et al. | 123/90.33 |
| 2006/0046540 | A1 * | 3/2006 | Ikeya et al. | 439/127 |
| 2008/0006255 | A1 * | 1/2008 | Sikora | 123/634 |
| 2008/0029052 | A1 * | 2/2008 | Takemoto et al. | 123/169 PA |
| 2009/0205621 | A1 * | 8/2009 | Skinner et al. | 123/634 |
| 2011/0000456 | A1 * | 1/2011 | Smith et al. | 123/195 C |
| 2012/0291745 | A1 * | 11/2012 | Smith et al. | 123/195 C |
| 2014/0150746 | A1 * | 6/2014 | Valencia et al. | 123/193.3 |

* cited by examiner

*Primary Examiner* — Hieu T Vo
*Assistant Examiner* — Sherman Manley
(74) *Attorney, Agent, or Firm* — Greg Brown; Alleman Hall McCoy Russell & Tuttle, LLP

(57) ABSTRACT

A system for a cylinder head is provided. The system comprises a cam cover mounted on the cylinder head and including an oil separator and a coil on plug (COP) coupled to the oil separator via a snap-fit connection. The snap-fit connection holds the coil-on-plug in position and may provide a lower cost alternative to existing systems of retaining coil-on-plugs on a cam cover.

18 Claims, 5 Drawing Sheets

CAM COVER COIL ON PLUG RETENTION VIA OIL SEPARATOR

RELATED APPLICATIONS

The present application claims priority to U.S. Provisional Application No. 61/443,609 filed on Feb. 16, 2011, and U.S. Provisional Application No. 61/444,392 filed on Feb. 18, 2011, the entire contents of each of which are hereby incorporated by reference for all purposes.

FIELD

The present disclosure relates to a positive crankcase ventilation system for an engine.

BACKGROUND AND SUMMARY

Engines may utilize positive crankcase ventilation (PCV) systems to reduce engine emissions. Specifically, pressurized gasses from the engine's crankcase may contain various hydrocarbons. By routing the pressurized gasses back to the engine intake, the gasses can be inducted into the engine cylinder, thus burning the hydrocarbons in the cylinder. However, oil may be entrained in the pressurized gasses, and thus oil separators may be used on the intake side of the PCV system to reduce oil inducted in the intake system. Such oil separators may be integrated into the engine cam cover to reduce costs.

In some engines, the effectiveness and degree of oil separation required in some engines can cause the size of the oil separator, and thus portions of the cam cover, to grow significantly. Such increased size can sometimes have degrading secondary effects on various components, such as coil-on-plug assemblies coupled to the engine's spark plugs.

The inventor herein has recognized the above issues, and has further recognized a way to use the oil separator's increased size (an otherwise disadvantageous attribute), to advantage. In one example, a system for a cylinder head is provided, comprising a cam cover including an oil separator, the cam cover mounted on the cylinder head, and a coil on plug (COP), the COP coupled to the oil separator via a snap-fit connection.

In one embodiment, the snap-fit connection may include a ball lock assembly in one embodiment, and the COP may be fastened to the cam cover via the ball lock assembly. The ball lock assembly may be comprised of a ball that extends out of the cam cover and is supported via retention arms and ribs. Further, the ball lock assembly may be articulated with a socket feature contained on the COP.

In this way, the increased size of the oil separator can be configured to provide the COP retention, rather than simply taking up more under-hood packaging space. For example, by extending the ball out of the cam cover's oil separator using retention arms and ribs, the COP assembly can utilize the oil separator structure to support retention of the COPs.

Furthermore, in some examples, specially designed inserts typically are included in the cam cover to house and/or receive a fastener. Use of the ball lock assembly as described may eliminate use of the fastener, if desired. Thus, by utilizing a ball and socket retention system, a lower cost connection with reduced assembly time can be achieved.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Embodiments of an oil separator coil-on-plug (COP) retention feature are disclosed herein. Such a retention feature may use the oil separator structural configurations to enable a ball and socket joint to attach a COP to a cam cover, as described in more detail hereafter.

Figure 1:
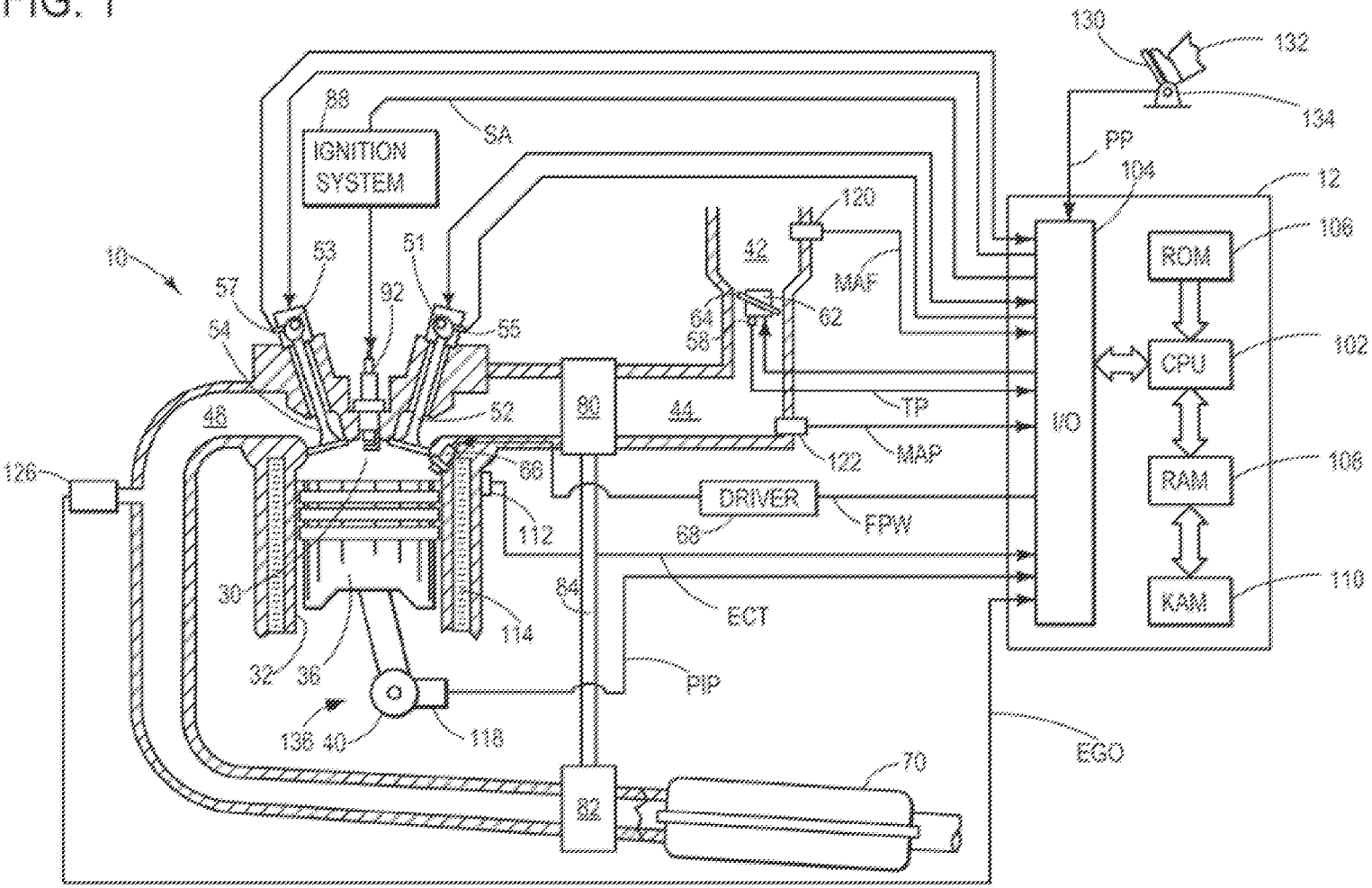
FIG. 1 shows a schematic depiction of an internal combustion engine.

Referring to FIG. 1, internal combustion engine 10, comprising a plurality of cylinders, one cylinder of which is shown in FIG. 1, is controlled by electronic engine controller 12. Engine 10 includes combustion chamber 30 and cylinder walls 32 with piston 36 positioned therein and connected to crankshaft 40. Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. Alternatively, one or more of the intake and exhaust valves may be operated by an electromechanically controlled valve coil and armature assembly. The position of intake cam 51 may be determined by intake cam sensor 55. The position of exhaust cam 53 may be determined by exhaust cam sensor 57.

Intake manifold 44 is also shown intermediate of intake valve 52 and air intake zip tube 42. Fuel is delivered to fuel injector 66 by a fuel system (not shown) including a fuel tank, fuel pump, and fuel rail (not shown). The engine 10 of FIG. 1 is configured such that the fuel is injected directly into the engine cylinder, which is known to those skilled in the art as direct injection. Fuel injector 66 is supplied operating current from driver 68 which responds to controller 12. In addition, intake manifold 44 is shown communicating with optional electronic throttle 62 with throttle plate 64. In one example, a low pressure direct injection system may be used, where fuel pressure can be raised to approximately 20-30 bar. Alternatively, a high pressure, dual stage, fuel system may be used to generate higher fuel pressures. Additionally or alternatively a fuel injector may be positioned upstream of intake valve 52 and configured to inject fuel into the intake manifold, which is known to those skilled in the art as port injection.

Distributorless ignition system 88 provides an ignition spark to combustion chamber 30 via spark plug 92 in response to controller 12. Universal Exhaust Gas Oxygen (UEGO) sensor 126 is shown coupled to exhaust manifold 48 upstream of catalytic converter 70. Alternatively, a two-state exhaust gas oxygen sensor may be substituted for UEGO sensor 126.

Converter 70 can include multiple catalyst bricks, in one example. In another example, multiple emission control devices, each with multiple bricks, can be used. Converter 70 can be a three-way type catalyst in one example.

Controller 12 is shown in FIG. 1 as a conventional microcomputer including: microprocessor unit 102, input/output ports 104, read-only memory 106, random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing force applied by foot 132; a measurement of engine manifold pressure (MAP) from pressure sensor 122 coupled to intake manifold 44; an engine position sensor from a Hall effect sensor 118 sensing crankshaft 40 position; a measurement of air mass entering the engine from sensor 120; and a measurement of throttle position from sensor 58.

In a process hereinafter referred to as ignition, injected fuel is ignited by an ignition source, such as spark plug 92, resulting in combustion.

When the air-fuel mixture is combusted in the engine combustion chamber 30, a small portion of the combusted gas may enter the engine crankcase 136 through the piston rings. This gas is referred to as blow-by gas. To prevent this untreated gas from being directly vented into the atmosphere, a positive crankcase ventilation (PCV) system is provided between the higher pressure crankcase 136 and the lower pressure intake manifold 44 to allow the blow-by gas to flow from the crankcase 136 into the intake manifold 44 and be mixed with fresh air. From here, the gas may be re-inducted into the combustion chamber 30 for re-combustion.

Engine 10 may further include a turbocharger having a compressor 80 positioned in intake manifold 44 coupled to a turbine 82 positioned in exhaust manifold 48. A driveshaft 84 may couple the compressor to the turbine. Thus, the turbocharger may include compressor 80, turbine 82, and driveshaft 84. Exhaust gases may be directed through the turbine, driving a rotor assembly which in turn rotates the driveshaft. In turn the driveshaft rotates an impeller included in the compressor configured to increase the density of the air delivered to combustion chamber 30. In this way, the power output of the engine may be increased. In other embodiments, the compressor may be mechanically driven and turbine 82 may not be included in the engine. Further, in other examples, engine 10 may be naturally aspirated.

FIGS. 2-7 show images of an internal combustion engine and various views of a cam cover, oil separator, and a COP retained to the cam cover via the oil separator ball lock assembly. FIGS. 2-7 are all approximately drawn to scale. Furthermore, only one example COP is shown attached to the cam cover. However, it is to be understood that all cylinders of the engine can have a COP configured above them, and that all COPs can be retained by the ball lock assembly.

Figure 2:
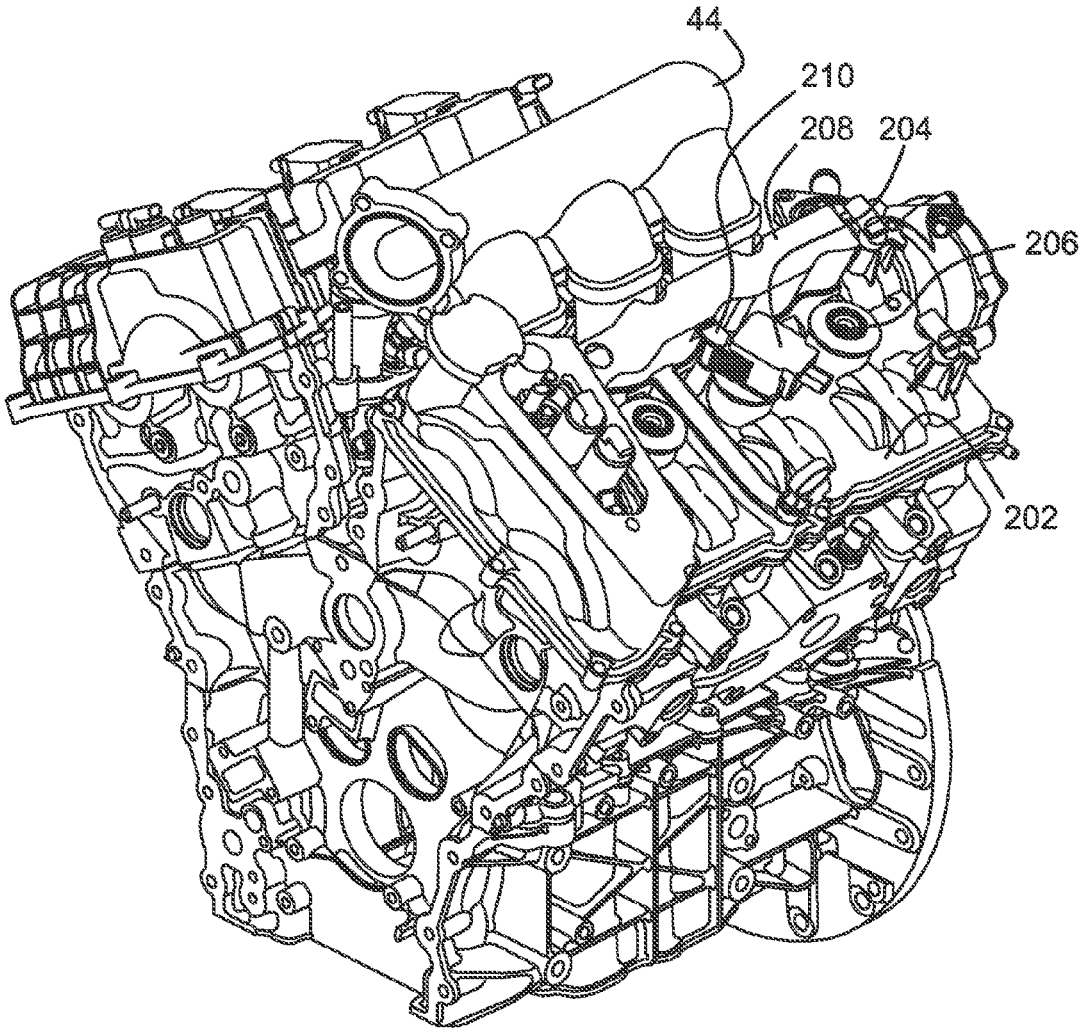
FIG. 2 is an isometric view of an internal combustion engine.

FIG. 2 shows an isometric view of the internal combustion engine 10. The intake manifold 44 is distributing intake air to a plurality of cylinders. In this embodiment, six cylinders are depicted; however, any number of cylinders in any arrangement is within the scope of this disclosure. The internal components including the spark plug, cylinder, combustion chamber, piston, and crankcase described above with respect to FIG. 1 are covered by a cam cover 202 which is mounted on the cylinder head. Configured on top of the cam cover 202 is an example coil on plug (COP) 204. COPs provide voltage to spark plugs in order to provide spark needed to initiate combustion. Each spark plug has its own ignition coil, which allows each ignition coil a longer time to accumulate a charge between sparks relative to an ignition system where a single ignition coil provides charge to a plurality of spark plugs. COP 204 extends through the cam cover 202 in a passage 206 down to sit directly on a spark plug (not shown). Previous configurations utilized standard M5 or M6 fasteners to attach the COPs to the cam cover. However, while this fastening strategy has proven reliable, it potentially exceeds the requirement of the joint, resulting in increased costs. To take advantage of a PCV oil separator structure, the COP 204 is instead attached to the cam cover via the PCV oil separator 208 using a ball lock assembly 210.

As described above with regard to FIG. 1, blow-by gas can escape through the piston rings and enter the crankcase. Engine lubrication oil used to lubricate moving parts of the engine is present in the crankcase during normal engine operation. The high pressure in the crankcase causes some of the lubricating oil to be suspended in a mist form. This oil mist can then mix with the blow-by gas and be returned to the intake manifold for combustion via a communication passage. However, combustion of the oil may cause the net oil consumption to increase, as well as degrade engine emission quality.

To address these issues, an oil separator, such as described in more detail below, may be used to separate the oil content from the blow-by gas containing the oil mist. After separation, the oil is returned to the engine lubricating system while the blow-by gas is returned to the engine intake system. For example, the oil separator may contain multiple distinct chambers and/or baffles to increase effective oil separation and control air blow-by rate. Such features in the oil separators can result in the separator having a large and/or bulky shape. For example, the oil separator 208 in FIG. 2 extends to or above the level of the COPs in a direction substantially perpendicular to the face of the cam cover. To take advantage of the oil separator being in close proximity to the COPs, the COPs can be captured by snap-fit connections, such as ball lock assemblies, extending out from the wall of the oil separator, as will be described in greater detail below.

Figure 3:
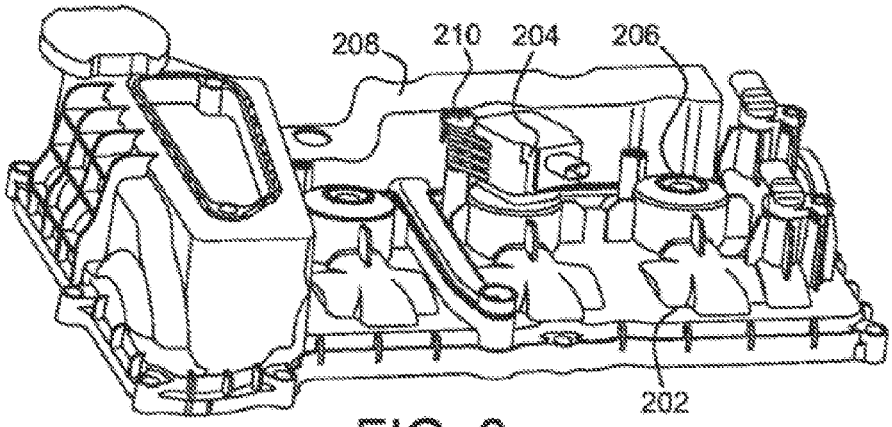
FIG. 3 is an isometric view of a cam cover, oil separator, and COP of FIG. 2.

FIG. 3 shows a detailed view of the oil separator 208 which is mounted on and extends above the cam cover 202. The oil separator 208 may be substantially rectangular in shape, extending lengthwise along the length of the engine bank and may be formed of plastic or another suitably rigid material. The oil separator houses a series of chambers containing projections to separate oil out of the blow-by gas, such as described in more detail below with regard to FIG. 7. While the oil separator may be comprised of similar material as the cam cover, the separator and cam cover may not comprise a single molded piece. Rather, the oil separator may be a separate piece that is ultrasonically welded on the cam cover, for example.

The cam cover 202 contains passages 206 which extend down to the spark plugs (not shown). Each passage houses a COP, although only one example COP 204 is depicted in FIG. 3. The COPs are attached to the oil separator 208 via a ball lock assembly 210. As described above, the oil separator 208 extends to a height that is at least equal to the height of the COP 204. The ball lock assemblies are arranged near the top of the oil separator on the outer wall facing the COPs. Again, only one ball lock assembly 210 is depicted, but each COP is attached to the oil separator via a respective ball lock assembly. The ball lock assembly 210 may be molded into the oil separator 208 and thus utilizes the oil separator structure to provide support to retain the COP 204 in place. While a ball lock assembly comprising a ball-and-socket joint is depicted in FIG. 3, another snap-fit connection including a joint extending out of the oil separator that may be housed in the COP may be used to couple the COP to the oil separator. Example snap-fit connections include a cantilevered beam or a torsional snap-fit connection.

Figure 4:
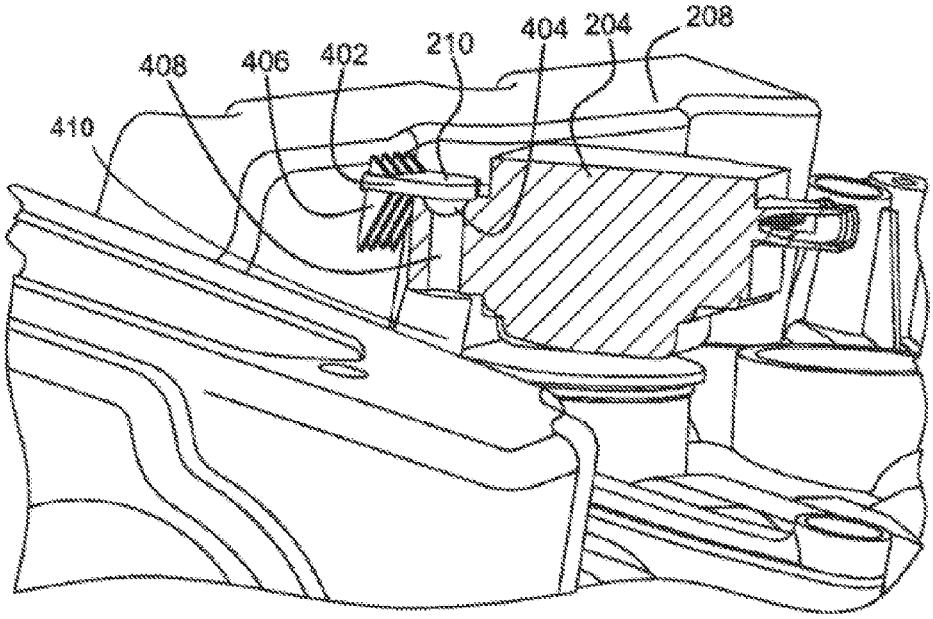
FIG. 4 shows a cut-away view of a COP attached to a cam cover via the retention feature.

FIG. 4 shows the ball lock assembly 210 engaging an example COP 204. The ball lock assembly comprises a ball-and-socket joint molded into the oil separator 208. The ball portion of the joint comprises an arm 402 protruding out from the wall of the oil separator 208. On the bottom of the arm is a ball 404. Enabling support of the arm 402 and ball 404 are retention ribs 406. The ball lock assembly may be made out of any suitable material that provides structural rigidity. For example, the ball lock assembly may be made out of the same material as the oil separator, such as plastic, to facilitate simplicity during the manufacturing process. Furthermore, the arm 402, ball 404, and ribs 406 may be made out of similar material, or in alternative embodiments, they may be make out of different materials.

When the COP 204 is in its installed position, the ball 404 sits in a socket connector 408 of the COP. Seen in cut-away view, the socket connector 408 is comprised of a bore that extends through COP 204 and is situated between the ball 404 and a cam cover post 410. The ball 404 may be positioned on a top of the bore. In some examples, cam cover post 410 may extend at least partially into socket connector 408 of COP when COP 204 is installed, for example it may extend at least partly into a bottom of the bore. As such, cam cover post 410 can limit lateral or side to side motion of COP 204. As the top of the bore is substantially concave in shape, it can provide a housing to retain the ball 404. In this manner, the COP 204 is retained with a clamp load provided by the arm 402 and ball 404. The arm and ball are designed to be under tension, providing the necessary clamp load to retain the COP. Furthermore, the cam cover post 410 provides structural support to the COP by providing a base for the COP 204 when fastened with the ball-and-socket joint.

Figure 5:
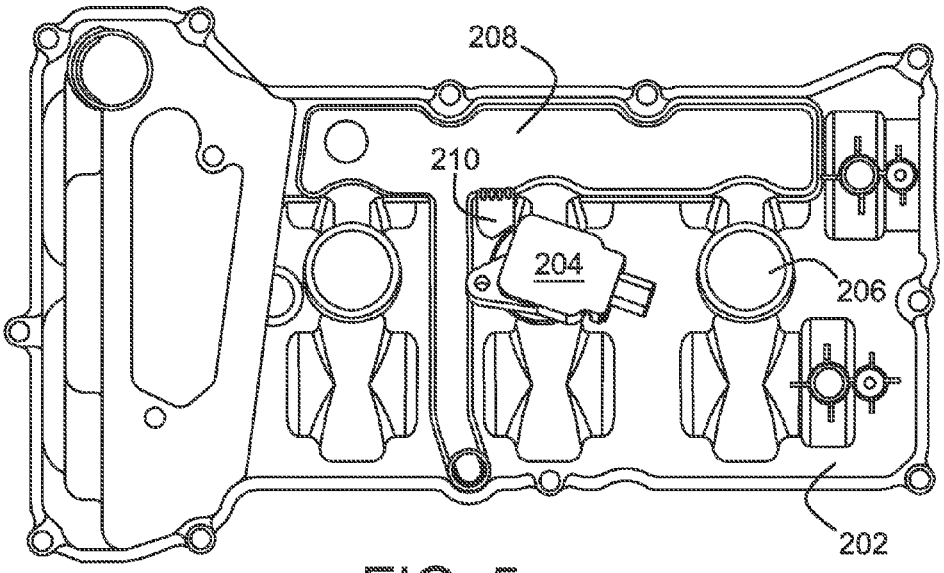
FIG. 5 shows a top view of a cam cover with a COP in the "start" position.
Figure 6:
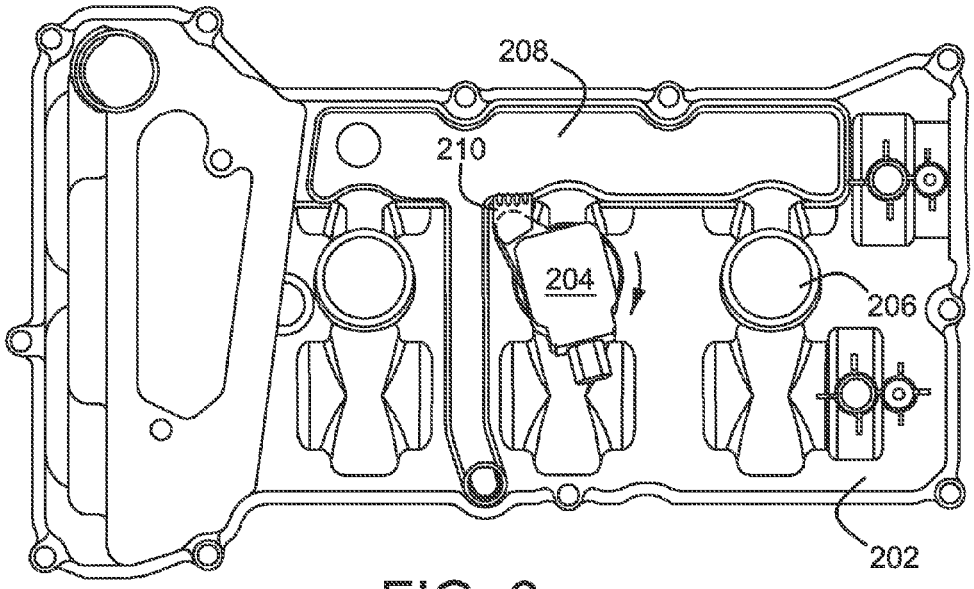
FIG. 6 shows a top view of a cam cover with a COP in the installed position.

FIGS. 5 and 6 show example assembly of the COP. Specifically, the figures show COP positions relative to the ball lock assembly before and after installation of the COP. In FIG. 5, the COP 204 is not engaged with the ball lock assembly 210 and the socket 408 of the COP is rotated approximately 45 degrees counterclockwise from the ball lock assembly. However, as the COP 204 is not engaged with the assembly 210, it is not being held in any specific position. In FIG. 6, the COP 204 has been rotated approximately 45 degrees clockwise until the socket connector 408 of the COP 204 snaps in place with the ball 404 of the ball lock assembly 210. The COP 204 can also be released from retention for servicing, removal, etc. The COP 204 is rotated counterclockwise until the clamp load exerted by the retention arm 402 and ball 404 is released. However, other rotation angles and rotation directions to install and release the COP may also be used, if desired.

Figure 7:
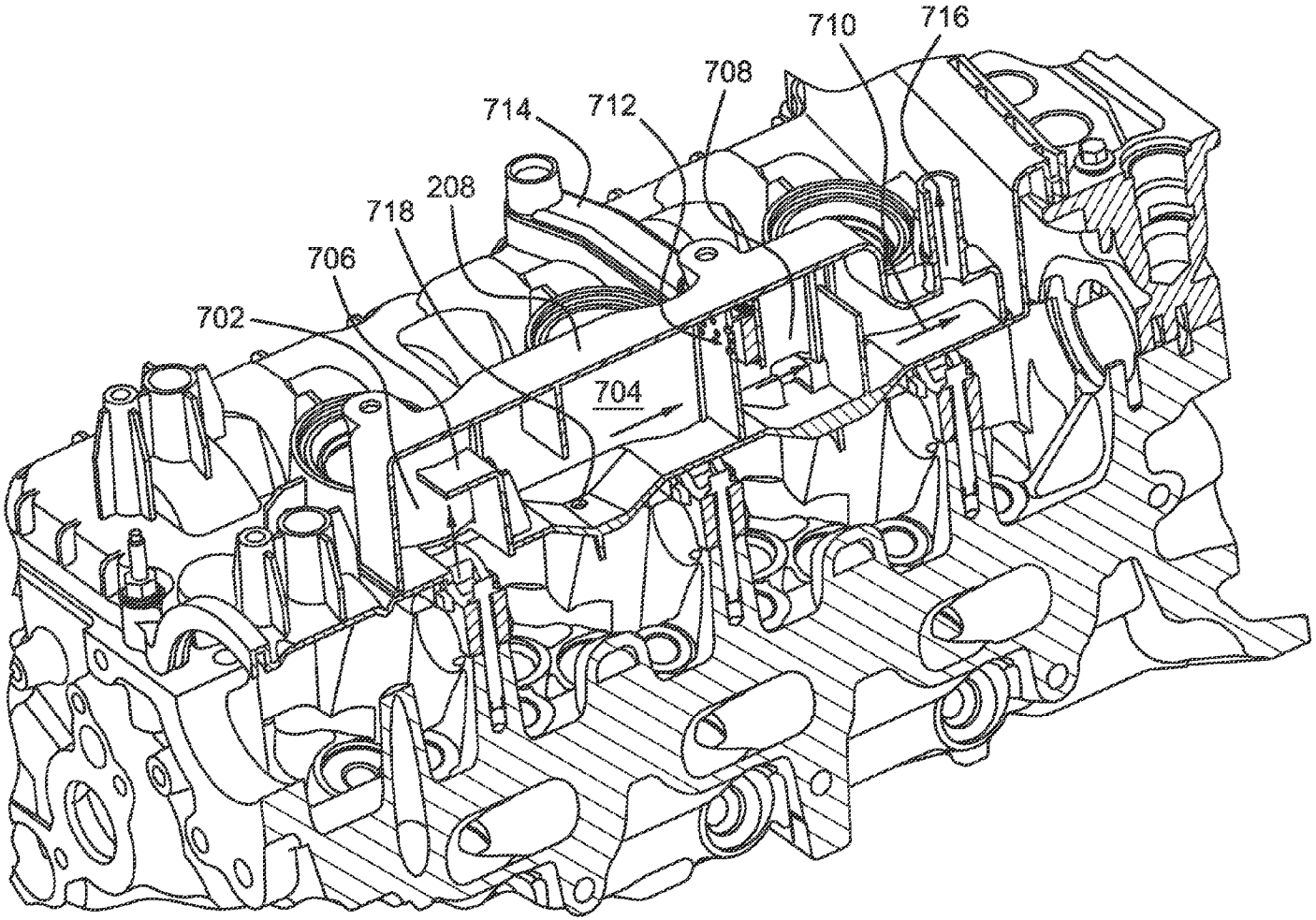
FIG. 7 is a cut-away view of an oil separator mounted on an engine.

FIG. 7 shows a cut-away view of an oil separator 208. As indicated by the arrows, air from the crankcase, which can contain uncombusted fuel, is taken into the separator due to the air flowing from the higher pressure crankcase to the lower pressure intake manifold, and is controlled via the PCV valve (not shown). Air flows into a first chamber 702 of the separator and then into a second chamber 704. Extending within and between the chambers are projections, or baffles 706. When the air hits the baffles, oil droplets suspended in the air will be forced out of the air and accumulate on the bottom of the separator. Positioned between chambers 704 and 708 is a perforated baffle 712. In chamber 708, air passing through the perforated baffle 712 is mixed with air from passage 714, which leads up from the crankcase and is also configured to house a dipstick (not shown) for determining oil levels in the oil lubrication system. Air then flows through chamber 710 and out passage 716, where it is taken into the intake manifold to be combusted. Oil that accumulates after hitting the baffles can be distributed back to the crankshaft via drain holes in the separator, for example hole 718.

Thus, a system for retaining a COP on a cylinder head is disclosed. The system comprises a cam cover containing an oil separator situated on a cylinder head, a COP, and a ball lock assembly extending out of an outer wall of the oil separator. The ball lock assembly has an arm with a ball contained underneath the arm that is retained by retention ribs. The ball engages a socket connector of the COP. This ball lock assembly allows the COP to be orientated in proper position to enable an electrical connection with a spark plug. The assembly further provides retention of the COP within the cylinder head and allows a means to service and/or remove the COP. The assembly accomplishes these requirements while reducing costs over existing retention methods.

In another example, an engine system is provided including a PCV system including an oil separator positioned on an exterior of a cam cover, with a COP positioned adjacent to the oil separator and with the COP coupled in the cam cover via a snap-fit connection between the COP and the oil separator. Further, the oil separator may be in communication with a dip stick passageway.

It will be appreciated that the configurations and methods disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A system for a cylinder head, comprising:

a cam cover including an oil separator, the cam cover mounted on the cylinder head; and a coil on plug (COP), the COP coupled to the oil separator via a snap-fit connection, the snap-fit connection comprising a ball lock assembly extending out of an outer wall of the oil separator.

2. The system of claim 1, wherein the ball lock assembly couples the COP to the cam cover.

3. The system of claim 1, wherein the ball lock assembly comprises a ball coupled to an arm, the arm extending out of the oil separator.

4. The system of claim 3, wherein the ball and arm are supported via one or more retention ribs coupled to the arm and oil separator.

5. The system of claim 3, wherein the ball is configured to be positioned in a socket connector of the COP.

6. The system of claim 5, wherein the socket connector comprises a bore within the COP, and wherein the ball is configured to be positioned on a top of the bore.

7. The system of claim 6, further comprising a cam cover post, the cam post configured to extend at least partially within a bottom of the bore.

8. A coil on plug (COP) assembly for an internal combustion engine, comprising:

a cam cover including an oil separator;

a COP extending through a passage of the cam cover; and a ball lock assembly coupling the COP to the cam cover via the oil separator.

9. The COP assembly of claim 8, wherein the ball lock assembly comprises a ball that extends out of the oil separator.

10. The COP assembly of claim 9, further comprising a retention system comprising a retention arm and one or more retention ribs to support the ball.

11. The COP assembly of claim 10, wherein the retention arm and ribs are coupled to the oil separator.

12. The COP assembly of claim 8, further comprising a socket contained on the COP, wherein the ball lock assembly is articulated with the socket.

13. An engine system, comprising a PCV system including an oil separator positioned on an exterior of a cam cover; and a coil on plug (COP) positioned adjacent to the oil separator, the COP coupled within the cam cover via a snap-fit connection between the COP and the oil separator, the oil separator extending to or above a top face of the COP.

14. The engine system of claim 13, wherein the oil separator is in communication with an oil dipstick passageway.

15. The engine system of claim 13, wherein the COP extends through a passage of the cam cover.

16. The engine system of claim 13, wherein the snap-fit connection comprises a ball lock assembly.

17. The engine system of claim 16, wherein the ball lock assembly comprises a ball-and-socket joint extending out of the oil separator, the ball-and-socket joint configured to be at least partly housed in a socket of the COP.

18. The engine system of claim 17, wherein the socket of the COP is configured to at least partly house a cam cover post.

* * * * *